US005154679A

United States Patent [19]

Fuller et al.

[11] Patent Number: 5,154,679

[45] Date of Patent: Oct. 13, 1992

[54] METHOD OF ASSEMBLING A HEAT EXCHANGER USING A FIN RETAINER

[75] Inventors: Jack J. Fuller, Memphis; Joe T. Cason, Collierville, both of Tenn.

[73] Assignee: Carrier Corporation, Syracuse, N.Y.

[21] Appl. No.: 748,735

[22] Filed: Aug. 22, 1991

[51] Int. Cl.[5] ..... B23D 15/26

[52] U.S. Cl. ..... 29/890.047; 29/890.043; 165/76

[58] Field of Search ..... 29/890.047, 890.043, 29/890.045, 523, 726; 165/76

[56] References Cited

U.S. PATENT DOCUMENTS

| | | | |
|---|---|---|---|
| 4,601,088 | 7/1986 | Kopczynski | 29/890.047 |
| 4,839,950 | 6/1989 | Stroup | 29/890.047 |
| 4,858,296 | 8/1989 | Gray | 29/890.047 |
| 4,858,305 | 8/1989 | Gray et al. | 29/523 |
| 4,876,779 | 10/1989 | Gray | 29/890.047 |

*Primary Examiner*—Irene Cuda

[57] ABSTRACT

Following the step of lacing the hair pin tubes into the plate fins, a plurality of plastic retainer elements are placed onto the hair pin tubes and into a budding relationship with top plate fin to thereby retain it in place while the tube bundle is transferred to the expansion table.

7 Claims, 2 Drawing Sheets

METHOD OF ASSEMBLING A HEAT EXCHANGER USING A FIN RETAINER

BACKGROUND OF THE INVENTION

This invention relates generally to a heat exchanger assembly method and, more particularly, to an improved process for the assembly of plate fin heat exchanger coils.

A plate fin heat exchanger coil is commonly constructed with a plurality of flat, parallel plates having laterally spaced holes therein for receiving refrigerant tubes, or hair pin tubes, therein. At each end of the plate fin bundle, there is a tube sheet composed of heavier material, and adjacent the upper tube sheet, the open ends of the hair pin tubes are fluidly connected by way of 'U' shaped return bends that are secured thereto by way of brazing or the like. When the coils are installed into a refrigeration system, the refrigerant is made to flow through the hair pin tubes, and the air to be cooled or heated is made to flow over the plate fins, such that a heat transfer is thereby affected.

In the assembly of plate fin heat exchangers, it is common to receive the individual plate fins from a plate fin harvester and to stack them on a rod assembly for subsequent transfer, as a bundle, to the guide rods on the lacing table. After the hair pin tubes are laced or assembled into the fin bundles, the entire assembly is then moved to a different area to facilitate the process of expanding the tubes radially outwardly to tightly engage the inner surfaces of the plate fins. It is during this transfer process that, since the holes in the plate fins are necessarily larger than the outer diameter of the hair pin tubes, the plate fins tend to slide along the tubes and may come completely off he tube. This causes not only a loss of material but also a loss of time that results from the need to replace those plate fins or, to an inferior structure in the event that they are not replaced.

It is therefore an object of the present invention to provide an improved method for assembly of plate fin heat exchangers.

Another object of the present invention is the provision in a plate fin heat exchanger assembly process for maintaining the integrity of the assembled components between the lacing and expansion processes.

Yet another object of the present invention is the provision for assembling a plate fin heat exchanger in an economical and effective manner.

The objects and other features and advantages become more readily apparent upon reference to the following descriptions when taken in conjunction with the appended drawings.

SUMMARY OF THE INVENTION

Briefly, in accordance with one aspect of the invention, a flat plastic retainer element, having an opening with a diameter slightly less than the outer diameter of the tubes, is placed over the tubes and into direct engagement with the last plate fin that was installed, such that the retainer then prevents the plate fins from sliding along the length of the tubes during the time when the assembly is being transferred to an apparatus that expands the tubes against the inner diameters of the plate fin holes. Because the retainers are small and relatively innocuous, they need not be removed after they have performed their desired function.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
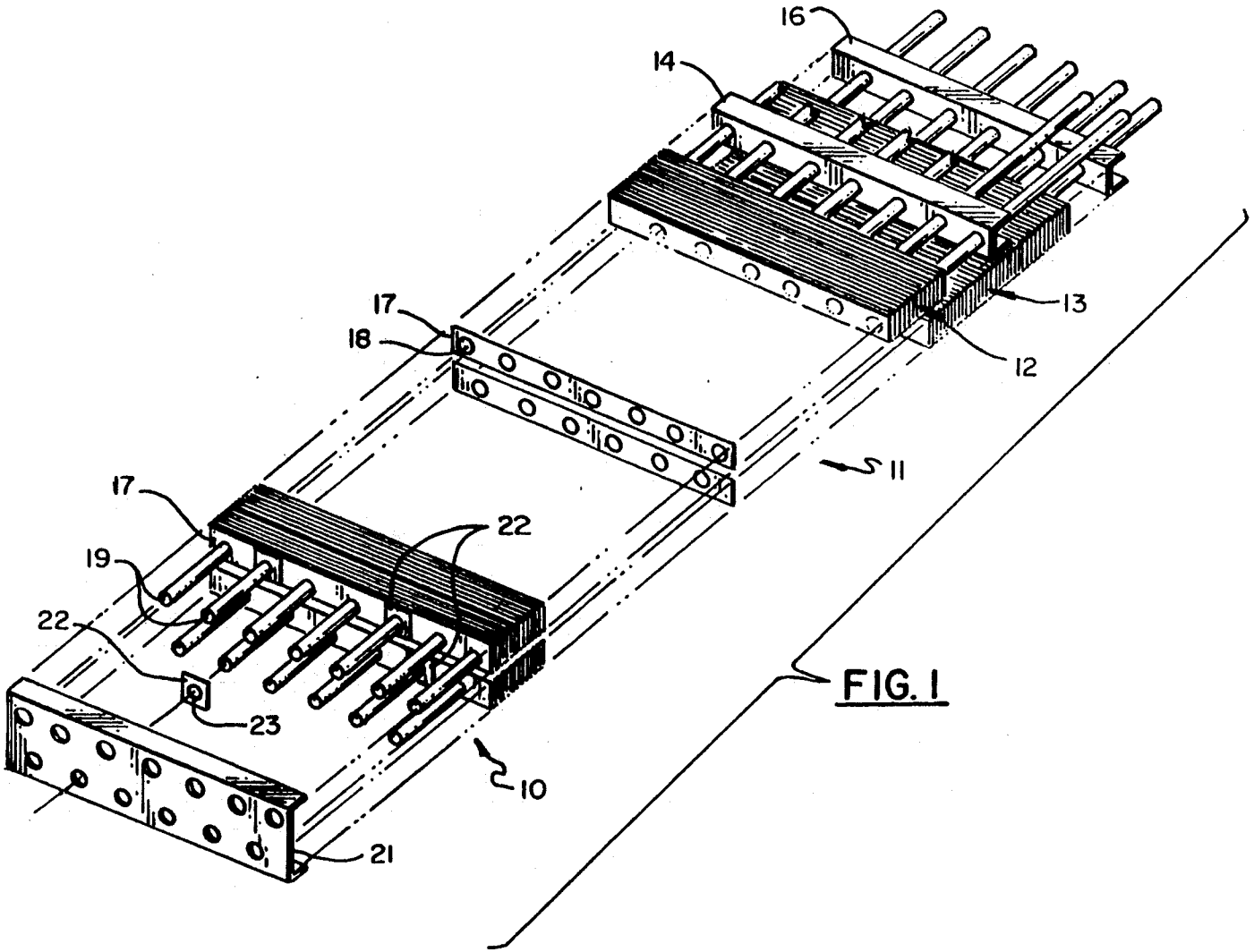
FIG. 1 is an exploded view of a heat exchanger coil in accordance with the present invention.

Referring now to FIG. 1, the invention is shown generally at 10 as applied to an otherwise conventional heat exchanger coil 11 comprising inner and outer sections 12 and 13. As will be seen, the inner coil section 12 is substantially shorter than the outer coil section 13 such that when the combination is formed into a U-shape, the respective tube sheets 14 and 16 will end up in side-by-side alignment because of the fact that the outer coil section 13 is required to span a greater distance.

Each of the inner and outer coil sections 12 and 13 are assembled in substantially the same way. The plate fins 17, having a single row of holes 18 formed therein, are stacked in a bundle as shown with the holes 18 in axial alignment for receipt of hair pin tubes 19 therein. Individual plate fins 17 are relatively thin (i.e. in the range of 0.0045 inches thick) and are stacked in relatively high density configurations (e.g. in the range of 20 fins per inch), by means of self spacing collars at each tube hole 18. The plate fins 17 are initially stacked on parallel guide rods (not shown) passing through the holes 18. The lower tube sheets 14 and 16 are then installed on the guide rods. The guide rods are then simultaneously withdrawn and replaced with the hair pin tubes 19 , a process which is referred to as the lacing process. The coil sections are then taken from the lacing table and placed on carts to be transferred to the expansion table. It is during this step that the individual plate fins 17 tend to come off of the hair pin tubes 19. Thus, unless those lost plate fins are replaced, the bundles are incomplete when they reach the expansion table, where the upper tube sheet 21 is installed over the plate fins 17 and the hair pin tubes 19 are expanded, such as by mechanically forcing a "bullet" into the internal bore, to thereby displace the outer surface of the tube into a tight fit relationship within the holes 18 to promote a good heat transfer relationship therebetween. Return bends (not shown) are then installed on the belled ends of the hair pin tubes 19 and brazed into place.

The present invention is involved with that part of the process at the completion of the lacing process and prior to movement of the coil bundles to the expansion table. A plurality of retainer elements 22 are provided with openings 23 having a diameter just slightly less than the outer diameter of the hair pin tubes 19. The retainer elements are composed of a somewhat flexible material such that they can be installed over the hair pin tubes 19 as shown. They are then slid along the hair pin tubes 19 until they are in abutting relationship with the top plate fin 17 to thereby hold it in place. As will be seen, there are two retainer elements 22 for each of the inner 12 and outer 13 coil sections. While it may be possible to accomplish the retaining function by a single retainer element 22 on a central hair pin tube 19, it is desired that a pair of retainers 22 be placed in symmetric relationships such that each of the two ends of the plate fins 17 are prevented from coming off of the hair pin tubes 19. Since the retainers 22 are formed of a thin sheet material (preferably in the range of 0.008 to 0.015 inches), they may be left in place when the tube sheet 21 is installed and the expansion process is executed.

Figure 2:
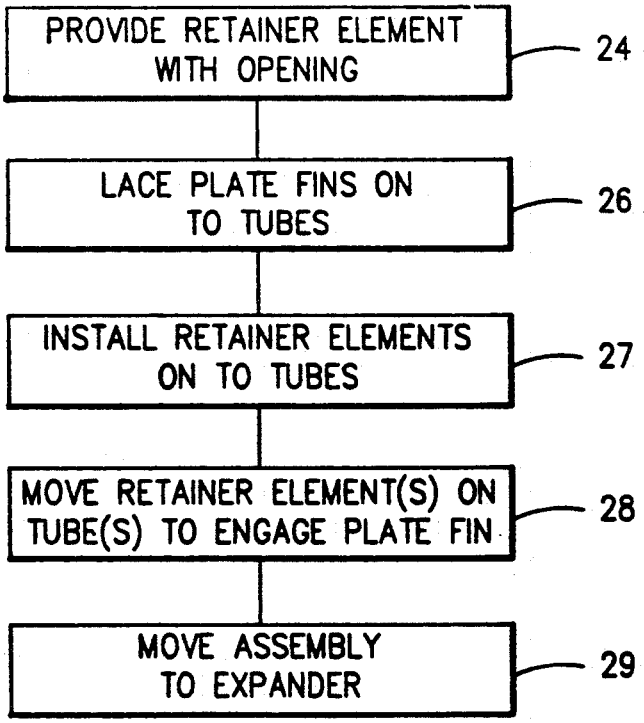
FIG. 2 is a flow chart showing the various steps in the present invention.

The inventive process therefore involves the providing of a supply of retainer elements 22, which is preferably done by way of a roll of material which can be cut into individual pieces. This step is shown in block 24 of FIG. 2. After the plate fins have been laced over the tubes (block 26), the retainer elements 22 are placed on the tubes as shown in block 27. The retainer elements 22 are then slid along the tubes until they engage the top plate fin 17 to thereby retain it in place (see block 28). The assembly can then be moved to the expander (block 29) without loss of the plate fins 17.

Although this invention has been shown and described with respect to a preferred embodiment, it will be understood that those skilled in the art the various changes in the form and detail thereof may be made without departing from the spirit and scope of the claimed invention.

What is claimed:

1. An improved method of assembling a plate fin coil of the type having a plurality of plate fins being laced on to a plurality of tubes and the tubes then being expanded to a close fit relationship within the holes of the plate fins, wherein the improvement comprises the steps of;

forming a retainer element of a pliable material, having an opening formed therein with a diameter slightly smaller than the outer diameter of said tube; and following the lacing step, installing said retainer sheet over one of the tubes and into engagement with one of the plate fins thereby retaining the plate fins in position on the tubes until the tubes are subsequently expanded.

2. An improved method as set forth in claim 1 wherein said retainer sheet is comprised of a plastic material.

3. An improved method as set forth in claim 1 wherein said retainer sheet has a thickness of less than 0.015 inches.

4. A method of assembling a plate fin coil of the type having plate fins and at least one tube, comprising the steps of;

forming the plate fins with holes having a greater diameter than that of the outer diameter of the tube(s);

installing the tubes into the holes of the plate fins;

forming, from a flexible material, a retainer element having an opening slightly smaller than the outer diameter of the tube(s);

placing said retainer element over the tube until it engages one of the plate fins to thereby prevent the plate fins from moving along the length of the tube(s); and expanding the tubes outwardly to create a snug fit relationship within the fin coil holes.

5. A method as set forth in claim 4 wherein said retainer element is composed of a plastic material.

6. A method as set forth in claim 4 wherein retainer elements are placed on more than one tube in a coil.

7. A method as set forth in claim 6 wherein said plurality of retainer elements are symmetrically located on said plurality of tubes.

* * * * *